US010401090B2

(12) United States Patent
Ollila

(10) Patent No.: US 10,401,090 B2
(45) Date of Patent: Sep. 3, 2019

(54) METHOD AND ARRANGEMENT FOR MEASUREMENT OF ELECTRODE PASTE IN AN ELECTRODE COLUMN OF AN ELECTRIC ARC FURNACE

(71) Applicant: OUTOTEC (FINLAND) OY, Espoo (FI)

(72) Inventor: Janne Ollila, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 416 days.

(21) Appl. No.: 15/107,279

(22) PCT Filed: Dec. 30, 2014

(86) PCT No.: PCT/FI2014/051065

§ 371 (c)(1),
(2) Date: Jun. 22, 2016

(87) PCT Pub. No.: WO2015/101714

PCT Pub. Date: Jul. 9, 2015

(65) Prior Publication Data

US 2018/0195803 A1 Jul. 12, 2018

(30) Foreign Application Priority Data

Dec. 30, 2013 (FI) ..... 20136334

(51) Int. Cl.
*F27D 19/00* (2006.01)
*F27B 3/28* (2006.01)
(Continued)

(52) U.S. Cl.
CPC ..... *F27D 19/00* (2013.01); *F27B 3/28* (2013.01); *F27D 11/08* (2013.01); *F27D 21/00* (2013.01);
(Continued)

(58) Field of Classification Search
CPC .. F27B 3/085; F27B 3/28; F27D 11/08; F27D 11/10; F27D 19/00; F27D 11/00; F21D 21/00; H05B 7/10
(Continued)

(56) References Cited

U.S. PATENT DOCUMENTS 4,696,014 A * 9/1987 Orrling ..... H05B 7/09 373/89
4,761,892 A 8/1988 Jankkila
(Continued)

FOREIGN PATENT DOCUMENTS

CN 1434269 A 8/2003
CN 101228284 A 7/2008
(Continued)

OTHER PUBLICATIONS

International Search Report (PCT/ISA/210) dated Mar. 20, 2015, by the European Patent Office as the International Searching Authority for International Application No. PCT/FI2014/051065.
(Continued)

*Primary Examiner* — Dana Ross
*Assistant Examiner* — Michael S. Poetzinger
(74) *Attorney, Agent, or Firm* — Buchanan, Ingersoll & Rooney PC

(57) ABSTRACT

A method and an arrangement measures electrode paste in an electrode column of an electric arc furnace. The electrode column has a steel casing, is provided with a contact shoe ring, and is filled with electrode paste introduced from above and evolving from raw paste in the upper part of the steel casing to melted paste and to baked paste in the lower part of the electrode column. The level of the raw paste is determined with a laser beam transmitted by a first laser device. The level of the molten paste is determined with a laser beam transmitted by a second laser device. The data
(Continued)

received from the laser devices is used for calculation of the distances of the levels of the raw paste and molten paste from the contact shoe ring.

4 Claims, 2 Drawing Sheets

(51) Int. Cl.

| | |
|---|---|
| ***F27D 21/00*** | (2006.01) |
| ***F27D 11/08*** | (2006.01) |
| ***F27D 21/02*** | (2006.01) |
| ***H05B 7/109*** | (2006.01) |
| ***H05B 7/09*** | (2006.01) |

(52) U.S. Cl.
CPC ..... *F27D 21/02* (2013.01); *H05B 7/09* (2013.01); *H05B 7/109* (2013.01); *F27D 2019/0071* (2013.01)

(58) Field of Classification Search
USPC ..... 373/88–92, 97
See application file for complete search history.

(56) References Cited

U.S. PATENT DOCUMENTS

| | | | | |
|---|---|---|---|---|
| 7,095,777 | B2 * | 8/2006 | Sidorski ..... | H05B 7/152 373/100 |
| 9,417,321 | B2 * | 8/2016 | Sadri ..... | F27B 3/085 |
| 2003/0235231 | A1 | 12/2003 | Rincon et al. | |
| 2011/0272865 | A1 | 11/2011 | Shameli et al. | |
| 2013/0127653 | A1 | 5/2013 | Dienenthal et al. | |

FOREIGN PATENT DOCUMENTS

| | | | |
|---|---|---|---|
| CN | 102884388 | A | 1/2013 |
| CN | 102972093 | A | 3/2013 |
| EP | 1 209 243 | A2 | 5/2002 |
| JP | 2-298791 | A | 12/1990 |
| JP | 3-008290 | A | 1/1991 |
| JP | 5-251177 | A | 9/1993 |
| JP | 5-251179 | A | 9/1993 |
| WO | WO 01/88472 | A1 | 11/2001 |
| WO | 2004028213 | A1 | 1/2004 |
| WO | 2010108625 | A1 | 9/2010 |

OTHER PUBLICATIONS

Written Opinion (PCT/ISA/237) dated Mar. 20, 2015, by the European Patent Office as the International Searching Authority for International Application No. PCT/FI2014/051065.

International Preliminary Report on Patentability (PCT/IPEA/409) dated Nov. 26, 2015 for International Application No. PCT/FI2014/051065.

Notification of the Second Office Action from the State Intellectual Property Office of the People's Republic of China dated Mar. 14, 2019 in Chinese Application No. 201480071541.1 with English Translation, 14 pages.

Notification of the First Office Action from the State Intellectual Property Office of the People's Republic of China dated Sep. 5, 2018, 7 pages.

Opinion on Patentability dated Aug. 20, 2014 from the Finnish Patent and Registration Office, 7 pages.

* cited by examiner

METHOD AND ARRANGEMENT FOR MEASUREMENT OF ELECTRODE PASTE IN AN ELECTRODE COLUMN OF AN ELECTRIC ARC FURNACE

FIELD OF THE INVENTION

The present invention relates to a method and an arrangement for measurement of electrode paste in an electrode column of an electric arc furnace. More specifically, the invention relates to a method for measurement of electrode paste in an electrode column of an electric arc furnace, which electrode column comprises a steel casing surrounding and covering the electrode paste formed of a graphite-based material and said electrode column being provided with a contact shoe ring formed of contact shoe elements and placed in contact with the steel casing to conduct electric current to the electrode, in which method the electrode column is filled with electrode paste by introducing said paste from above into the steel casing, whereby the electrode paste evolves through different phases, ranging from raw paste in the upper part of the steel casing to melted paste in the area starting above the contact shoe ring and further to baked paste in the lower part of the electrode column below the contact shoe ring. Further, the invention relates to an arrangement for measurement of electrode paste in an electrode column of an electric arc furnace, which electrode column comprises a steel casing surrounding and covering the electrode paste formed of a graphite-based material and said electrode column being provided with a contact shoe ring formed of contact shoe elements and placed in contact with the steel casing to conduct electric current to the electrode, whereby the electrode column is filled with electrode paste by introducing said paste from above into the steel casing, in which the electrode paste evolves through different phases, ranging from raw paste in the upper part of the steel casing to melted paste in the area starting above the contact shoe ring and further to baked paste in the lower part of the electrode column below the contact shoe ring.

BACKGROUND OF THE INVENTION

An electric arc furnace is an electrically operated furnace used for melting metal and/or for cleaning slag. The operation of the furnace is based on an arc flame that burns either between separate electrodes, or between electrodes and the material to be melted. The furnace may be operated either by AC or DC cur-rent. Heat is created in the arc flame, and also in the material to be melted, in the case where the arc flame burns between the material and the electrodes. Electric power is conducted to vertical electrodes that are usually located symmetrically in a triangle with respect to the midpoint of the furnace. In the case of a DC smelting furnace there is one electrode in the middle of the furnace. The assembly depth of the electrodes in the furnace is continuously adjusted, because they are worn at the tips owing to the arc flame.

A Söderberg-type electrode of an electric arc furnace is a vertical column comprising a steel casing sur-rounding and covering the electrode paste formed of a graphite-based material. The electrode column is continuously filled with the electrode paste which is introduced from above into the steel casing. The paste is subject to different conditions along the column making it evolve through different phases, ranging from raw paste in the upper part of the steel casing to melted paste in the area starting above the contact shoe ring and further to baked paste in the lower part of the electrode column below the contact shoe ring.

In addition to the contact shoe ring the lower part of the electrode column assembly comprises a pressure ring and a heat shield. The contact shoe ring consists of a plurality of contact shoe elements arranged as a ring to be in contact with a steel casing inside of which the electrode paste is sintered. The contact shoe elements conduct electric current to the electrode. A pressure ring is arranged on the outside of the contact shoe ring, so that the contact shoe ring is surrounded by said pressure ring. The pressure ring consists of a plurality of pressure blocks connected with each other as a ring pressing the contact shoes against the steel casing of the electrode. A heat shield surrounding the electrode column assembly is arranged above the pressure ring in the axial direction of the electrode column assembly. Also the heat shield is comprised of a plurality of segments connected with each other to form an assembly of annular form.

So, because the furnace must be operational continuously and uninterruptedly electrode paste must continuously be introduced into the steel casing. Therefore, one must all the time be aware of the height of the paste column, i.e. of the level of paste in the vertical direction in order to know when and how much paste must further be introduced into the steel casing. Further, because the state of paste is transformed along the height of the paste column from raw paste to softened or melted paste and further to baked paste it is important to know on which level the surface of the melted paste each time exists. This information is used e.g. in the control of the process. Excessive soft paste levels as well as inadequate soft paste levels cause different detrimental effects on the operation of the furnace.

Different methods and equipment have been used for determination of the length and/or state of the electrodes in electric-arc furnaces. Nowadays the determination and measurement of the surface levels of the paste column is normally carried out manually with a wire or tape as measuring instrument. Manual measurement and determination is not always exact enough and further it is sometimes quite difficult to perform due to the extreme environmental circumstances.

As examples of other prior art methods and equipment reference is made to publication EP1209243A2 disclosing a multifrequency equipment for sensing the state of the electrodes in electric-arc furnaces. Publication WO2004/028213A1 discloses an electrode column and a method of determining the length of the electrode in said column in an active furnace. The column is a Söderberg column including a mantel in which the electrode is movable in an axial direction by movable slipping clamps. Publication US2013/0127653A1 discloses a device and an apparatus for measuring the length of an electrode or determining the position of a consumable cross-section of the electrode in an electric furnace, in which the measuring is performed by radar. Publication U.S. Pat. No. 4,761,892 discloses an apparatus for measuring the length of the electrodes in an electric furnace, wherein the measurement is performed by a measuring rod inserted into the furnace.

OBJECTIVE OF THE INVENTION

An objective of the present invention is to provide a method and an arrangement for measurement of electrode paste in an electrode column of an electric arc furnace which method and arrangement overcome the disadvantages and drawbacks relating to prior art, especially when it comes to the problems relating to the measurement in a harsh environment and to the utilization of the measurement results in the process control.

SUMMARY OF THE INVENTION

The objectives of the present invention are attained by the inventive method for measurement of electrode paste in an electrode column of an electric arc furnace, which method is characterized by

- providing a plurality of laser devices on the top of the electrode column, said laser devices each transmitting laser beams downwards,
- determining the level of the raw paste in the steel casing corresponding to the height of the paste cylinder in the steel casing with the laser beam transmitted by a first laser device,
- determining the level of the molten paste in the steel casing with the laser beam transmitted by a second laser device, and
- utilizing the data received from the laser devices for calculation of the distances of the levels of the raw paste and molten paste from the contact shoe ring.

The method is further characterized by

- providing a reference rod on the electrode column at a constant distance from the contact shoe ring,
- determining the position of the reference rod with the laser beam transmitted by a third laser device, and
- using the position data of the reference rod to improve the accuracy of the calculation of the distances of the levels of the raw paste and molten paste from the contact shoe ring.

Further, in the method the data received from each laser device is supplied to an automation system of the furnace for calculation and presenting the calculation results online on a user interface.

The objectives of the present invention are further attained by the inventive arrangement for measurement of electrode paste in an electrode column of an electric arc furnace, in which arrangement

- a plurality of laser devices is provided on the top of the electrode column to transmit laser beams downwards, so that
- the laser beam from a first laser device is arranged to determine the level of the raw paste in the steel casing corresponding to the height of the paste cylinder in the steel casing,
- the laser beam from a second laser device is arranged to determine the level of the molten paste in the steel casing, whereby
- the data received from the laser devices is used to calculate the distances of the levels of the raw paste and molten paste from the contact shoe ring.

Further, in the arrangement

- a reference rod is provided on the electrode column at a constant distance from the contact shoe ring,
- a third laser device is provided for the determination of the position of the reference rod with the laser beam transmitted by said third laser device, whereby
- the position data of the reference rod is used to improve the accuracy of the calculation of the distances of the levels of the raw paste and molten paste from the contact shoe ring.

Still further, the data received from each laser device is arranged to be supplied to an automation system of the furnace for calculation and presenting the calculation results online on a user interface.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1:
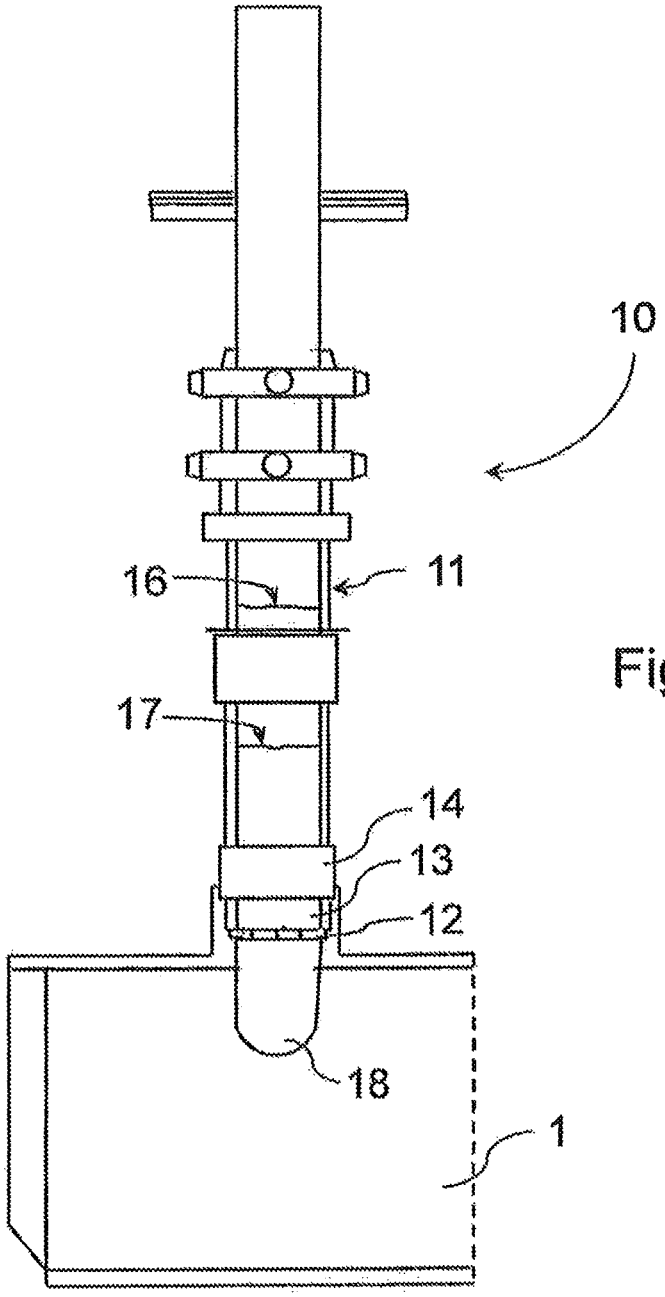
FIG. 1 is a schematic elevation side view of a electrode column assembly and a part of an electric arc furnace.

FIG. 1 shows a schematic illustration of a part of an electric arc furnace 1. The furnace 1 comprises at least one electrode column assembly but it may comprise a plurality of said electrode column assemblies depending on the type and structure of the furnace.

The vertical electrode column 10 comprises a steel casing 11 which surrounds and covers the electrode paste formed of a graphite-based material. The electrode column 10 is continuously filled with the electrode paste which is introduced from above into the steel casing 11. The paste is subject to different conditions along the column making it to evolve through different phases, ranging from raw paste in the upper part of the steel casing 11 to melted paste in the area starting above the contact shoe ring 12 and further to baked paste 18 in the lower part of the electrode column 10 below the contact shoe ring 12.

In addition to the contact shoe ring 12 the lower part of the electrode column assembly comprises a pressure ring 13 and a heat shield 14. The contact shoe ring 12 consists of a plurality of contact shoe elements arranged as a ring to be in contact with a steel casing inside of which the electrode paste is sintered. The contact shoe elements conduct electric current to the electrode. A pressure ring 13 is arranged on the outside of the contact shoe ring 12, so that the contact shoe ring 12 is surrounded by said pressure ring 13. The pressure ring 13 consists of a plurality of pressure blocks connected with each other as a ring pressing the contact shoes against the steel casing 11 of the electrode. A heat shield 14 surrounding the electrode column assembly is arranged above the pressure ring 13 in the axial direction of the electrode column assembly. Also the heat shield 14 is comprised of a plurality of segments connected with each other to form an assembly of annular form.

As already explained above the material of the electrode wears during the use of the furnace and therefore electrode paste has to be added into the steel casing either continuously, cyclically or when necessary. So, it is all the time important to know the amount of the paste in the steel casing 11, the level of the paste cylinder 16 and the level of molten paste 17 in the casing 11.

Figure 2:
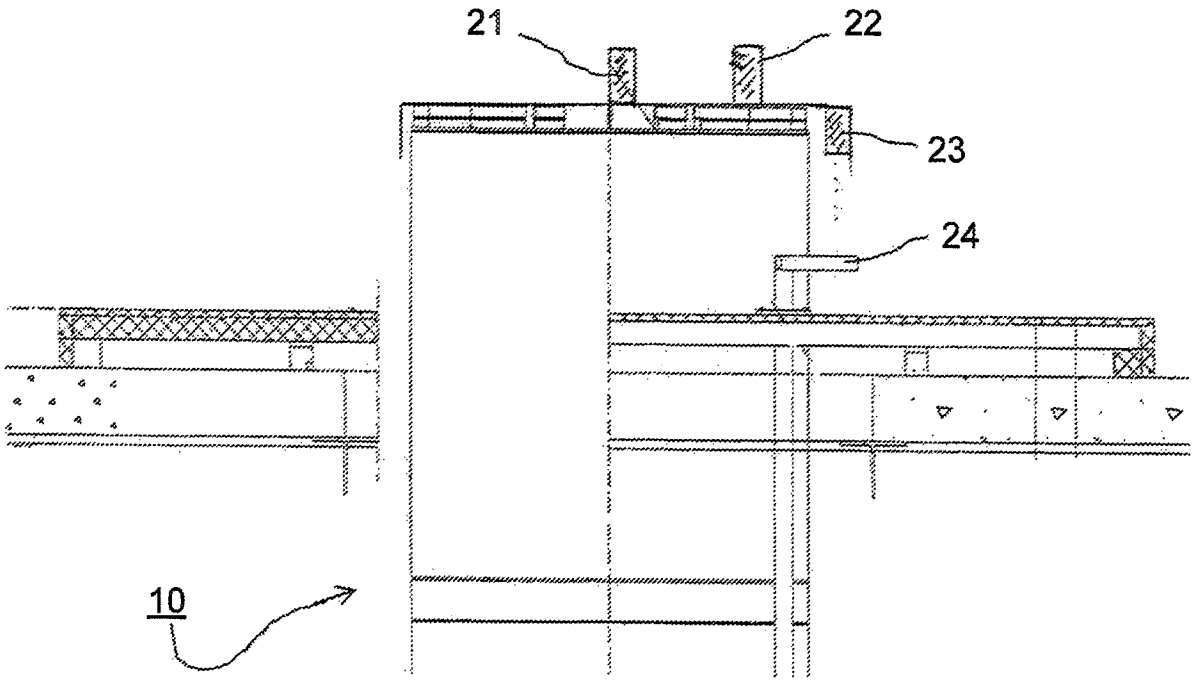
FIG. 2 is a schematic elevation side view of a detail on the upper portion of the electrode column assembly of FIG. 1.

As schematically depicted in FIG. 2, the measurement of the levels of electrode paste in the steel casing 11, i.e. in vertical direction of the electrode column 10, is performed with laser devices 21, 22, 23 arranged on the top of the electrode column 10. As shown in FIG. 2, three laser devices 21, 22, 23 are arranged on the top of the electrode column 10, said laser devices preferably transmitting a laser beam for measurement of the distance of the object from the laser device. The first laser device 21 measures the height of the paste cylinder 16 in the steel casing 11. That is to say, the first laser device 21 determines the level of the raw paste 16 in the steel casing 11. The second laser device 22 measures the height of the molten paste 17, or in other words determines the level of the molten paste 17 in the steel casing 11.

The third laser device 23 is arranged for reference measurement and for the third laser device 23 a reference rod 24 is mounted on the electrode column 10 on a constant distance from the contact shoe ring 12. The third laser device 23 determines the distance from the reference rod 24 to said third laser device 23, so that the relative position of the contact shoe ring 12 is continuously known and this is used as a reference data. So, when the exact relative position of the contact shoe ring 12 is known, the distances of the levels of the raw paste 16 and molten paste 17 in the steel casing 11 from the contact shoe ring 12 is calculated with the data received from the three laser devices 21, 22, 23. The calculation is performed in an automation system of the furnace and the results of the calculation are shown online on a user interface. Simple laser devices 21, 22, 23 transmitting a laser beam can be submitted by laser scanners, especially when it comes to the first and second laser devices.

By the present invention a continuous measurement is obtained and the measurement can be connected to an automation system. The automation system collects and stores the data which is then monitored and used for electrode control.

It is obvious to a person skilled in the art that with the advancement of technology, the basic idea of the invention may be implemented in various ways. The invention and its embodiments are thus not limited to the examples described above, instead they may vary within the scope of the claims.

The invention claimed is:

1. A method for measurement of electrode paste in an electrode column of an electric arc furnace, which electrode column comprises a steel casing surrounding and covering the electrode paste formed of a graphite-based material and said electrode column being provided with a contact shoe ring formed of contact shoe elements and placed in contact with the steel casing to conduct electric current to the electrode, in which method the electrode column is filled with electrode paste by introducing said paste from above into the steel casing, whereby the electrode paste evolves through different phases, ranging from raw paste in the upper part of the steel casing to melted paste in the area starting above the contact shoe ring and further to baked paste in the lower part of the electrode column below the contact shoe ring, said method comprising:

providing a plurality of laser devices comprising a first laser device and a second laser device on the top of the electrode column, said laser devices each transmitting laser beams downwards, determining the level of the raw paste in the steel casing corresponding to the height of the paste cylinder in the steel casing with the laser beam transmitted by the first laser device, determining the level of the molten paste in the steel casing with the laser beam transmitted by the second laser device, and utilizing the data received from the laser devices for calculation of the distances of the levels of the raw paste and molten paste from the contact shoe ring.

2. The method for measurement of electrode paste according to claim 1, further comprising:

providing a reference rod on the electrode column at a constant distance from the contact shoe ring, determining the position of the reference rod with the laser beam transmitted by a third laser device to determine the relative position of the contact shoe ring, so that when the relative position of the contact shoe ring is known, the distances of the levels of the raw paste and molten paste in the steel casing from the contact shoe ring is calculated with the data received from the three laser devices.

3. An arrangement for measurement of electrode paste in an electrode column of an electric arc furnace, which electrode column comprises a steel casing surrounding and covering the electrode paste formed of a graphite-based material and said electrode column being provided with a contact shoe ring formed of contact shoe elements and placed in contact with the steel casing to conduct electric current to the electrode, whereby the electrode column is filled with electrode paste by introducing said paste from above into the steel casing, in which the electrode paste evolves through different phases, ranging from raw paste in the upper part of the steel casing to melted paste in the area starting above the contact shoe ring and further to baked paste in the lower part of the electrode column below the contact shoe ring, wherein a plurality of laser devices comprising a first laser device and a second laser device is provided on the top of the electrode column to transmit laser beams downwards, so that the laser beam from the first laser device is arranged to determine the level of the raw paste in the steel casing corresponding to the height of the paste cylinder in the steel casing, the laser beam from the second laser device is arranged to determine the level of the molten paste in the steel casing, whereby an automation system of the furnace uses the data received from the laser devices to calculate the distances of the levels of the raw paste and molten paste from the contact shoe ring.

4. The arrangement for measurement of electrode paste according to claim 3, wherein a reference rod is provided on the electrode column at a constant distance from the contact shoe ring, a third laser device is provided for the determination of the position of the reference rod with the laser beam transmitted by said third laser device to determine the relative position of the contact shoe ring, whereby the automation system of the furnace uses the position data of the reference rod to calculate the distances of the levels of the raw paste and molten paste in the steel casing from the contact shoe ring with the data received from the three laser devices.

* * * * *